United States Patent [19]

Stockman

[11] 4,153,102

[45] May 8, 1979

[54] ROTOR POST

[75] Inventor: Richard F. Stockman, Friendship, N.Y.

[73] Assignee: The Air Preheater Company, Inc., Wellsville, N.Y.

[21] Appl. No.: 854,438

[22] Filed: Nov. 23, 1977

[51] Int. Cl.[2] ..... F28D 19/00

[52] U.S. Cl. ..... 165/8; 308/69; 308/244; 308/DIG. 12

[58] Field of Search ..... 165/8, 9, 10; 308/DIG. 10, 63, 69, 244

[56] References Cited

U.S. PATENT DOCUMENTS

| | | | |
|---|---|---|---|
| 3,024,005 | 3/1962 | Dore et al. | 165/8 X |
| 3,389,745 | 6/1968 | Wahlbeck | 165/9 |
| 4,019,568 | 4/1977 | Brzytwa | 165/8 |

*Primary Examiner*—Albert W. Davis, Jr.
*Attorney, Agent, or Firm*—Wayne H. Lang

[57] ABSTRACT

A cylindrical trunnion having a cooperating bearing that supports the rotor of a vertically disposed rotary regenerative air preheater. The trunnion has a high section modulus that is adapted to resist bending, while the support bearing therefor is adapted to be carried on independent support structure that resists axial and lateral movement. The bearing may be adjusted axially with respect to the support structure to raise the rotor from its support bearing, while a unique correlation of jacking means and independent shims permits removal of the bearing for replacement or repair.

7 Claims, 2 Drawing Figures

ROTOR POST

BACKGROUND OF THE INVENTION

The present invention relates to a rotary regenerative heat exchanger that comprises a series of sector-shaped compartments of heat absorbent material connected to and supported in radial juxtaposition outward from a central rotor post to comprise the rotor for the heat exchanger. The rotor includes a central trunnion that is rotatably supported by bearing means carried by independent housing structure. The rotor is subjected to hot and cold fluids whereby when rotated about its axis, heat from the hot fluid is transferred to the cool fluid through the intermediary of the heat absorbent rotor.

DESCRIPTION OF THE PRIOR ART

Various arrangements for a bottom support bearing adapted to rotatably support the rotor of a vertical shaft air preheater have been developed.

U.S. Pat. No. 4,019,568 issued on Apr. 26, 1977, illustrates an arrangement showing a typical manner of rotor support wherein a central rotor post is connected to elongate trunnions of solid forgings mounted on a support bearing that is contained in a housing held by bolts to the underside of a support beam. While such an arrangement may be satisfactory for small rotors under ideal conditions, it is heavy and cumbersome, it requires perfect alignment of parts, and it is consequently expensive to manufacture and to maintain. Moreover, removal and replacement of the bearing is a slow and difficult operation because a series of heavy bolts must be removed before special jacking means is adapted to lower the bearing away from its support structure thereby making it completely free.

It is apparent that the trunnion and cooperating bearing structure for the support of a rotor of a rotary regenerative air preheater may assume various embodiments involving standard design features, however none of these variations provide a bearing that is readily accessible, nor is such a bearing arranged to permit rapid removal for replacement or repair. Moreover, these arrangements are usually heavy and expensive to fabricate, install and maintain.

SUMMARY OF THE INVENTION

This invention accordingly provides an arrangement for the effective support of a rotor for a vertical shaft air preheater. The arrangement includes a lightweight cylindrical trunnion that is aligned with a central rotor post and supported upon independent bearing structure. The arrangement requires a minimum of structure for maximum support strength, it is easily accessible, and the bearing may be readily removed for replacement or repair.

BRIEF DESCRIPTION OF THE DRAWING

A more complete understanding of my invention may be realized by referring to the following description when viewed in addition to the accompanying drawing in which.

DESCRIPTION OF THE PREFERRED EMBODIMENT

Figure 1:
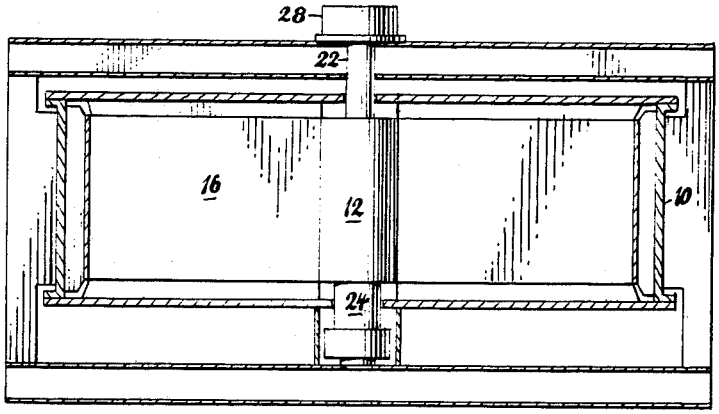
FIG. 1 is a sectional elevation of a rotary regenerative heat exchanger constructed in accordance with the invention.
Figure 2:
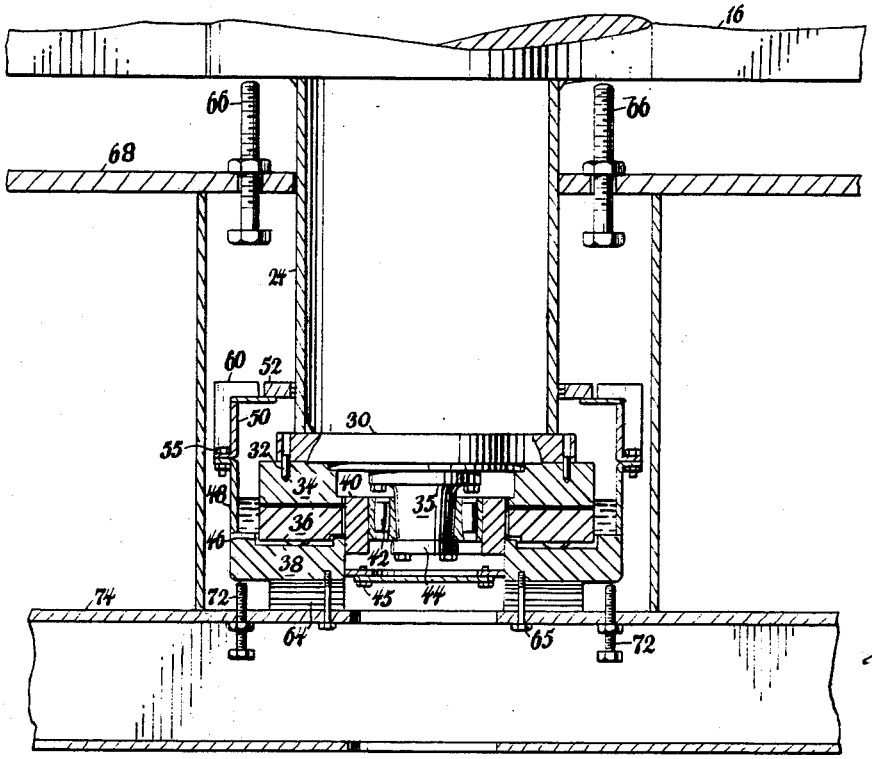
FIG. 2 is an enlarged sectional elevation showing the details of construction of the trunnion and the support bearing therefor.

In the apparatus shown in the drawing a rotor shell 10 is spaced concentrically about a central rotor post 12 to provide an annular space that is filled with heat absorbent element to comprise a rotor 16. The heat absorbent material is contacted by a stream of heating fluid and a stream of fluid to be heated that traverse the rotor in opposite directions while the rotor is being rotated about its axis by suitable drive means not shown in order that heat may be transferred from the heating fluid to the fluid to be heated.

The rotor post has an axially aligned upper trunnion 22 and lower trunnion 24, the upper trunnion being mounted for rotation in a guide bearing 28 while the lower trunnion 24 is mounted on a suitable support bearing 26 whereby the rotor may be constantly rotated about its axis by a prime mover not illustrated.

In accordance with this invention the lower trunnion 24 and axially aligned upper trunnion 22 are aligned with and connected to the central rotor post 12. The lower trunnion is comprised of a cylindrical outer wall that is disposed vertically upon end plate 30 and connected by pins 32 to a series of wear shoes 34 that lie in radially spaced relation about a central trunnion extension 35. The wear shoes slidably confront a series of pivotally mounted bearing plates 36 that are carried by an annular lower housing 38. The inner periphery of the annular housing 38 provides a support for a ring member 40 that confronts the outer periphery of a lower guide bearing 42 which in turn surrounds the trunnion extension 35. The guide bearing is held in position by a circular plate 44 which is bolted to the end face of the trunnion to provide a support flange therefor.

The bearing housing 38 is counter-bored at 46 to provide an annular holding surface for the bearing plates 36, while the outer periphery thereof provides a base for an annular wall 48 that extends axially to the approximate level of the upper surface of wear shoes 34.

The annular wall 48 completely surrounds the bearing members 34–36, while an extension member 50 is connected thereto and adapted to include an annular cover 52 that slidably abuts the trunnion to provide a continuous enclosure around the bearing members that precludes all foreign matter. The extension 50 is connected to the annular wall 48 by bolts 55 and stiffeners 60 whereby removal of bolts 55 will permit separation of the wall 48 and cap 50 for removal of the bearing therebetween.

A lifting device shown as jack screw 66 is adapted to rest upon permanent housing structure 68 and abut the rotor whereby said lifting means may be rotated to remove the entire weight of the rotor from the bearing 34–36 and support it upon the jack screws.

A lower lifting means 72 mounted on fixed support beam 74 is adapted to adjustably support the bearing housing 38 and the bearing assembly 34–36–38 thereon.

When bearing assembly 34–36–38 is to be repaired or replaced, bolts 55 connecting annular wall 48 to cap 50 are removed to permit separation of the cap from the annular wall. Holding plate 44 that supports guide bearing 42 is similarly released by removal of suitable connecting bolts 45. Upper jacking means 66 is then actuated to raise the rotor, trunnion 24, and end plate 30 relative to the heavy support and guide bearing assemblies whereby pins 32 become disengaged from the upper surface of wear shoes 34.

Lower jacking means 72 is then slightly advanced to raise the bearing assembly 34–36–38 alone until the shims 64 are completely free whereby holding pins 65 may be removed and the shims removed. After the shims have been removed, jacking means 72 is reversely actuated to lower the free bearing assembly 34–36–38 on to the upper surface of support beam 74 while the rotor and trunnion assembly is held in an elevated position by the extended lifting means 66.

When lowered the wear shoes 34 become free from all possible engagement with pins 32 whereby the entire bearing assembly 34–36–38 may be removed laterally while the rotor-trunnion assembly is supported upon the jacking means 66.

After the bearing assembly has been repaired or replaced, effecting an opposite procedure will quickly place the bearing back in service. Accordingly, after replacement the bearing assembly is axially aligned with the lower trunnion so the pins 32 may engage suitable openings in wear shoes 34. Jacking means 72 is then actuated to raise the bearing assembly until it closely abuts end plate 30. Shims 64 are then readily moved into axial alignment therewith to hold the bearing assembly in this relationship while the jacking means 72 may be backed off. Holding pins 65 may then be replaced along with end plate 44 and bolts 55 so the thrust bearing and guide bearing assemblies are complete in an operative manner.

Finally, lifting means 66 is backed off slowly to permit the entire rotor assembly to again be supported upon the upper surface of support beam 74 through the bearing assembly therebetween.

Various modifications and equivalents will be apparent to one skilled in the art and such changes may be made in the present invention without departing from the spirit or scope thereof. It is therefore to be understood that these modifications are to be considered within the terms of the present invention.

I claim:

1. Rotary regenerative heat exchange apparatus including a cylindrical rotor housing having walls at opposite ends thereof that include spaced apertures for a heating fluid and for a fluid to be heated, a rotor of heat absorbent material disposed about a vertical rotor post within said housing adapted to receive the heating fluid and the fluid to be heated, a support bearing for the rotor mounted on fixed support structure subjacent said rotor, shim means intermediate the support bearing and the support structure therefor adapted to transmit the load of the rotor to said support structure, a first lifting means intermediate the support bearing and its support structure adapted to move the bearing axially relative to said shim means, and a second lifting means for raising the rotor relative to said rotor housing to remove the load of the rotor from said support bearing whereby said first and second lifting means may be alternately actuated to vary the distance between the rotor and said support structure to permit removal of said shim means therebetween.

2. Rotary regenerative heat exchange apparatus as defined in claim 1 wherein the first jacking means traverses an opening in the support structure to permit actuation from the underside of said support structure.

3. Rotary regenerative heat exchange apparatus as defined in claim 2 wherein the first jacking means has a range of movement that exceeds the thickness of the shim means lying between the bearing and the support structure.

4. Rotary regenerative heat exchange apparatus as defined in claim 3 including a bearing support housing subjacent said bearing sized to include a flanged portion that concentrically surrounds the bearing.

5. Rotary regenerative heat exchange apparatus as defined in claim 4 including an annular housing mounted on the flanged portion of the bearing support housing that surrounds the bearing, and a cap extending in sealing engagement from the annular housing to the outer periphery of the lower trunnion to preclude the entry of foreign matter into the space that surrounds said bearing.

6. Rotary regenerative heat exchange apparatus as defined in claim 5 including retaining means that connects the shims to the support structure to preclude relative movement therebetween.

7. Rotary regenerative heat exchange apparatus as defined in claim 6 including a ring member connected to the inner periphery of the annular bearing housing, a trunnion extension axially aligned with said trunnion extending in radially spaced relation with said ring member, and bearing means therebetween adapted to preclude radial movement of said trunnion extension.

* * * * *